United States Patent [19]

Lake

[11] 4,007,397

[45] Feb. 8, 1977

[54] ARC DISCHARGE LAMP WITH STARTER ELECTRODE VOLTAGE DOUBLING

[75] Inventor: William H. Lake, Novelty, Ohio

[73] Assignee: General Electric Company, Schenectady, N.Y.

[22] Filed: Sept. 2, 1975

[21] Appl. No.: 609,505

[52] U.S. Cl. ..... 315/51; 315/60; 315/200 R; 315/234; 315/335

[51] Int. Cl.[2] ..... H05B 41/22

[58] Field of Search ..... 315/51, 60, 71, 200 R, 315/234, 264, 335; 313/25, 198, 229

[56] References Cited

UNITED STATES PATENTS

| | | | |
|---|---|---|---|
| 3,527,982 | 9/1970 | Lake | 315/200 R |
| 3,619,711 | 11/1971 | Freese, Jr. | 315/60 |
| 3,629,647 | 12/1971 | Lake | 315/59 |
| 3,666,986 | 5/1972 | Lake et al. | 313/198 X |
| 3,706,898 | 12/1972 | Peterson | 315/60 X |

FOREIGN PATENTS OR APPLICATIONS

| | | |
|---|---|---|
| 1,223,966 | 3/1971 | United Kingdom |

*Primary Examiner*—Eugene La Roche
*Attorney, Agent, or Firm*—Ernest W. Legree; Lawrence R. Kempton; Frank L. Neuhauser

[57] ABSTRACT

In a discharge lamp where the arc tube has main electrodes and a starter electrode, there is provided a voltage doubling circuit comprising a diode and a capacitor connected in series across the input terminals. The circuit is poled to generate a positive potential at the junction of diode and capacitor which is coupled through a resistor to the starter electrode. Voltage doubling may be provided across the gap from starter to adjacent main electrode or from starter to remote main electrode to improve starting. Where the arc tube contains sodium, the positive potential may also be applied to the arc tube frame to reduce sodium loss by electrolysis.

11 Claims, 6 Drawing Figures

ARC DISCHARGE LAMP WITH STARTER ELECTRODE VOLTAGE DOUBLING

The invention relates to high pressure arc discharge lamps and is especially applicable to such lamps containing a metallic halide fill such as sodium iodide.

BACKGROUND OF THE INVENTION

High pressure metal halide discharge lamps generally comprise a tubular fused silica arc tube containing an ionizable fill and having a pair of main thermionic electrodes in the ends. The electrodes are supported by inleads which include a thin molybdenum ribbon portion extending hermetically through a pinch or press seal in the end of the lamp. Generally a starter electrode is disposed in the arc tube adjacent one of the main electrodes to facilitate starting. In most lamps a discharge can be ignited between the starter and the adjacent main electrode at a much lower voltage than between the two main electrodes, and ignition of the arc between the main electrodes is thereby facilitated. The common practice has been to connect the starter electrode through a current limiting resistor, typically about 40,000 ohms, to the same side of the power supply as the opposite main electrode. This limits the starter current during normal operation to an insignificant percentage of the arc current.

During operation of metal vapor lamps and in particular metal halide lamps containing alkali or alkaline earth metal additives, electrolysis can occur within the press seal between the inleads of the starter and of the adjacent main electrode if an electric potential exists between them. Electrolysis occurs primarily as alkali ion displacement through the silica, and can always occur, irrespective of lamp fill, because high silica glass or fused silica contains minute quantities of alkali metals as impurities. However, it is much greater when an alkali metal, such as sodium in the form of an iodide, is provided as part of the lamp fill. Electrolysis causes the silica to devitrify and leads to cracking of the hermetic seal, or alternately it deteriorates the molybdenum ribbon to the point of failure.

Several schemes have been proposed to overcome the electrolysis problem and the most widely used is that of U.S. Pat. No. 3,226,597 — Green, which provides a thermal switch in the form of a bimetal element to electrically short circuit the starter electrode to the adjacent main electrode when the lamp reaches normal operating temperature. An alternative proposed by U.S. Pat. No. 3,619,711 — Freese, provides a semiconductor diode connected between the starter and the adjacent main electrode and poled to prevent the starter from developing a negative potential.

Most metal halide lamps include sodium iodide as part of the fill and sodium ions can migrate by electrolysis through the fused silica wall during operation. As sodium is selectively lost and freed iodine is left behind, the lamp spectrum deteriorates through loss of sodium radiation and the operating voltage may rise, ultimately to the point of lamp failure. When a conventional side rod construction is used for the mount or frame which supports the arc tube within the outer envelope, the radiant emission from the arc tube causes the side rods to emit photoelectrons. Some of these photoelectrons drift to the outer surface of the arc tube, charging it up negatively and accelerating the electrolysis of sodium ions through the fused silica. Sodium loss can be reduced by changing the mount frame or harness to a divided mount construction wherein the mount is in two sections, one extending from the stem and the other extending from the dome end of the outer envelope to the arc tube. However even with the divided mount construction, an appreciable loss of sodium continues to take place.

SUMMARY OF THE INVENTION

The object of the invention is to provide an arc discharge lamp having improved starting means which reduces the burden on the ballast or apparatus used to regulate the current supplied to the lamp, and which can also reduce electrolysis and alkali metal loss during operation.

A lamp embodying the invention comprises a vitreous arc tube having main electrodes at opposite ends and a starter electrode adjacent one of them, an ionizable fill in the arc tube, and a starter electrode voltage doubling (SEVD) circuit comprising a diode and a capacitor connected in series across the input terminals. The circuit is poled to generate a positive potential at the junction of diode and capacitor which is coupled through a resistor to the starter electrode. When the arc tube is enclosed in an outer jacket, the components of the voltage doubling circuit may be located in the inter-envelope space.

The diode serves to build up a charge across the capacitor on one-half cycle which is added to the line voltage on the opposite half cycle to substantially double the voltage provided between the starter and the selected main electrode. Voltage doubling may be provided across the gap from starter to adjacent main electrode, or across the gap from starter to remote main electrode to improve starting in different types of lamps.

In a preferred construction particularly suitable for lamps containing an alkali metal halide such as sodium iodide, the mount frame which supports the arc tube within the outer envelope is connected to the junction of diode and capacitor and other conductors are provided to supply current to the main electrodes. The positive potential which is supplied by the voltage doubling circuit to the mount frame is very effective in reducing sodium loss by electrolysis.

DESCRIPTION OF DRAWINGS

In the drawings wherein like symbols denote corresponding parts in the several figures.

DESCRIPTION OF PREFERRED EMBODIMENTS

Figure 1:
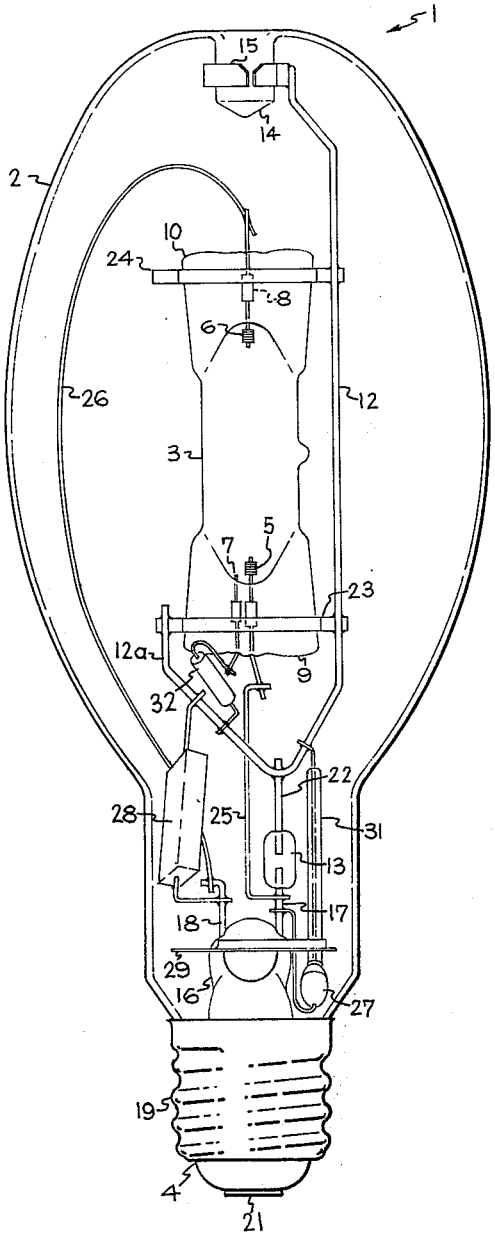
FIG. 1 is a front view of a base down metal halide lamp embodying the invention.

FIG. 1 illustrates a metal halide lamp intended for base down operation and embodying the invention in preferred form. The lamp 1 comprises a vitreous outer envelope or bulb 2 and a fused silica inner arc tube 3, the outer envelope having a screw base 4 at its lower end. The arc tube contains a quantity of mercury which is substantially completely vaporized and exerts a pressure from 1 to 10 atmospheres in operation, sodium iodide in excess of the quantity vaporized, and other suitable metal halides, for instance smaller amounts of thallium iodide and indium iodide. An inert rare gas at a low pressure, for instance argon at 25 torr, is included in the arc tube to facilitate starting and warm up. A pair of main arcing electrodes, 5 at the lower end and 6 at the upper end plus an auxiliary starting electrode 7 at the lower end are sealed into the arc tube. The electrodes are supported on inleads which include thin molybdenum foil sections 8 extending through the pinch sealed ends 9, 10 of the tube. Main electrodes 5, 6 each comprise a tungsten wire helix wrapped around a core wire and may include activating material such as thorium oxide filling the interstices between turns. The starter electrode 7 may be a fine tungsten wire whose tip only projects into the arc tube, for instance about 1 millimeter.

The arc tube is supported within the outer envelope by a single side rod mount comprising a rod or wire 12 extending from an insulating glass bead 13 at the base end to an anchoring dimple 14 in the dome end of the jacket which it engages by a clip 15. The neck of the jacket is closed by a reentrant stem 16 through which extend stiff inlead wires 17, 18 which are connected at their outer ends one to the screw shell 19 and the other to the center contact 21 of base 4. The lower end of rod 12 and its continuation **12*a* form a V to whose apex is welded a wire stub 22 which is seized in glass bead 13 attached to stiff inlead wire 17. The mount frame is thus mechanically supported by inlead 17 but electrically insulated therefrom. The arc tube is attached to the mount frame by clamping the pinches 9, 10 between straps 23, 24 which are welded to rod 12, 12*a*. Lower electrode 5 is connected to inlead 17 by wire 25. Upper electrode 6 is connected to inlead 18 by a fine resilient curving wire 26 which extends along the jacket wall at a distance from the arc tube. Curving wire 26** serves as an electrical conductor only and provides substantially no physical support to the arc tube.

In the illustrated embodiment, a voltage doubling circuit comprising diode 27 and capacitor 28 connected in series extends across inlead wire 17, 18 with frame **12, 12*a* providing the junction. Diode 27 extending from inlead 17 is poled to provide a positive potential at the junction. The diode is shielded from the heat of the arc tube by a heat shield in the form of a slotted aluminum disc 29 which straddles stem 16. The leads of the diode extend through the slot in the heat shield and at least one of them is insulated by a glass sleeve 31 to prevent a short circuit. Capacitor 28 which typically may have a value of 0.1 microfarad is a high temperature mica insulated capacitor which can withstand the heat. A current limiting resistor 32, typically of 40,000 ohms, is connected between starter electrode 7 and frame member 12*a*** which is the junction point between diode and capacitor.

Figure 2:
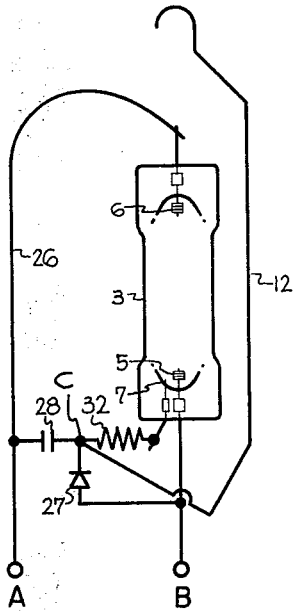
FIG. 2 is a diagram of the circuit connections of the lamp of FIG. 1.
Figure 3:
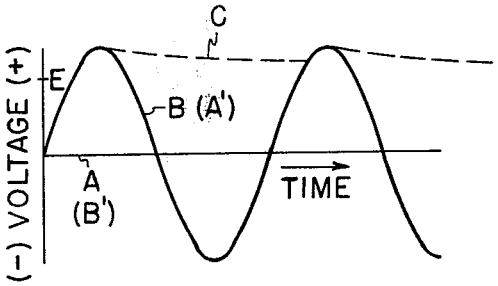
FIG. 3 shows the voltage waveforms obtained in the lamp of FIG. 1 under starting conditions.

The circuit connections of the lamp of FIG. 1 are shown diagrammatically in FIG. 2 and typical voltage waveforms at starting are illustrated in FIG. 3. The voltage waveforms are identified to correspond to the terminals where they occur. If terminal A which is tied directly to electrode 6 is considered the reference or ground point, curve B then represents the potential at terminal B and main electrode 5 applied by a ballast having an open circuit voltage of RMS value E. Capacitor 28 charges by current flow through diode 27 to the peak of the terminal voltage, that is to the value +1.4E. From one positive cycle peak to the next, current flow to the starting electrode will cause some capacitor discharge at an exponential rate determined by the effective R-C time constant of the discharge circuit comprising capacitor 28, resistor 32 and the voltage drop across the starter discharge path. The rate of discharge can be made quite low and in a typical case can be represented by dotted curve C. Since in any event the capacitor voltage is restored to the peak of the open circuit voltage at each cycle, it is substantially +1.4E during the starting process. During the negative half cycle, a potential rising to −1.4E is applied to electrode 5 relative to reference point A, which added to the charge of +1.4E maintained at starting electrode 7 by capacitor 28, results in a voltage of approximately +2.8E between starter 7 and adjacent main electrode 5. At the same time the mount frame 12 is maintained at a positive potential of +1.4E relative to remote main electrode 6, and at a potential varying from 0 to +2.8E relative to adjacent main electrode 5.

The lamp starting circuit of FIG. 2 is particularly effective in reducing the starting requirements, that is in lowering the open circuit voltage required to be provided by the ballast, in lamps where the Townsend breakdown voltage dominates the starting characteristic. The production of an arc discharge across the gap between main electrodes depends upon two limiting conditions of that gap: the Townsend breakdown voltage, sometimes called first breakdown, and the glow to arc transition voltage, sometimes called second breakdown. In lamps where the electrodes are activated in such a way as to be excellent electron emitters, as in mercury vapor lamps and metal halide lamps using thorium oxide activation of the electrodes, the first breakdown dominates the starting characteristic. For such lamps I have found that the voltage doubling circuit is most effective when connected to double the voltage across the starter-to-adjacent main electrode gap as illustrated in FIGS. 1 and 2. By applying positive voltage doubling to the starter electrode, the voltage required to be applied to the lamp terminals in order to start it is substantially less than required with the conventional prior arc circuit wherein the starter electrode is merely connected by a resistor to the opposite main electrode. Typical results obtained with the starter electrode voltage doubling (SEVD) circuit of the invention by comparison with the conventional starter circuit at various temperatures are given in Tables 1 and 2 below:

TABLE 1

| Conventional Starter Circuit | |
|---|---|
| Temperature | O.C.V. Required |
| −20° F | 280 volts |
| 50° F | 240 volts |

TABLE 2

| S.E.V.D. Circuit | | |
|---|---|---|
| Temperature | Capacitor | O.C.V. Required |
| −20° F | 0.05 MFD | 280 volts |
| −20° F | 0.1 MFD | 210 volts |
| 50° F | 0.1 MFD | 170 volts |
| −20° F | 0.5 MFD | 165 volts |

TABLE 2-continued

| | S.E.V.D. Circuit | |
|---|---|---|
| Temperature | Capacitor | O.C.V. Required |
| −20° F | 1.0 | 140 volts |

An advantage of the positive starter electrode voltage doubling circuit of my invention is the substantial elimination of electrolysis within the pressed seal about the starter electrode inlead. The amount of electrolysis that takes place when a positive bias is maintained on the starter electrode is negligible. I have conducted experiments to compare the effect of positive and negative potentials applied between the starter and main electrodes in high temperature environments. In forced tests, I have found that 6 hours of operation with 250 volt negative starter potential results in severe deposits in the starter foil region, while 18 hours of 250 volt positive potential operation results in no observable deposits. I believe the explanation for this surprising result lies in the temperature conditions of the seal. Heat developed at the main electrode and arc current flowing through the foil of the main electrode combine to make that foil hotter than that of the starter electrode, and this in turn causes much higher ion mobility in the quartz next to it. The driving force for electrolysis is a D.C. potential between starter and main foils. When the starter potential is negative, ions are drawn from a region of high mobility into one of lower mobility causing a concentration build-up. But with the starter electrode positive, ions are drawn from a region of low mobility to one of higher mobility so that concentration build up cannot occur. Irrespective of the explanation, I have found that with positive starter electrode voltage doubling, seal electroylsis ceases to be a problem and the thermal switch formerly used to short circuit the starter to the adjacent main electrode is no longer necessary and may be eliminated. In the past, one of the reasons that made different lamp designs for base-up and base-down operation necessary was the necessity to avoid the extreme temperature variations imposed on the bi-metal switch as between its location over the arc tube and its location under the arc tube. Since my new circuit eliminates the need for thermal switch, it also makes feasible a lamp design for universal operation.

In the preferred embodiment illustrated in FIG. 1, the voltage generated by the voltage doubling circuit is applied as a positive bias to frame 12, 12*a*. A very substantial benefit is achieved thereby in metal halide lamps which use sodium as a discharge species. Such lamps deteriorate by loss of sodium which occurs by electrolysis through the hot walls of the fused silica arc tube. By applying a positive bias to the mount structure in accordance with my invention as illustrated in FIGS. 1 and 2, a retarding potential is provided for photoelectrically generated electrons which virtually eliminates sodium electrolysis due to this cause. The need to resort to a divided mount in order to control sodium loss from the arc tube is eliminated. Thus the invention permits use of a sturdier mount and at the same time a longer operating life is achieved for the lamp.

Figure 4:
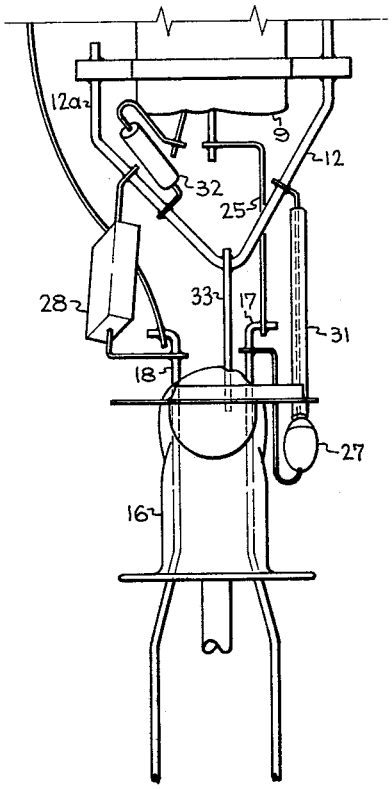
FIG. 4 is a fragmentary view of the stem in a variant.

FIG. 4 illustrates a variant of my invention in regards to the means for supporting the mount frame. The stem is provided with a third support wire or dummy inlead 33 which need not project outwardly of stem 16 but is merely seized in the glass. The apex of the V formed by frame members 12 and 12*a* is attached to dummy inlead 33 as by welding and the lamp construction is otherwise as illustrated in FIG. 1. The circuit is as diagrammatically represented in FIG. 2 and the operation of the lamp is unchanged.

Figure 5:
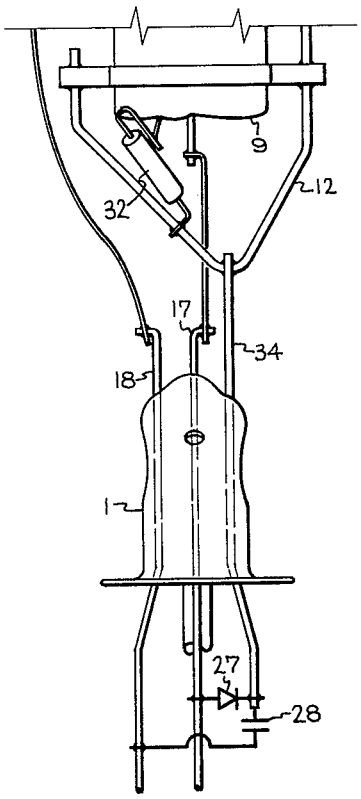
FIG. 5 is a fragmentary view of the stem in another variant.

Another variant of my invention wherein the diode and capacitor of the voltage doubling circuit are mounted externally of the outer envelope of the lamp is illustrated in FIG. 5. For this arrangement a three-lead stem wherein a third inlead 34 projects externally is required. Frame member 12, 12*a* is fastened to inlead 34 and diode 27 is connected between inlead 34 and inlead 17 outside of the lamp envelope. Capacitor 28 is connected between inlead 34 and inlead 18 and may likewise be placed outside of the envelope. A convenient arrangement is to place the diode and capacitor in the base shell where the temperature is lower than inside the outer jacket. In addition to reducing the temperature burden on the diode, this arrangement permits the use of a more compact and less expensive capacitor since it can operate at a lower temperature.

Figure 6:
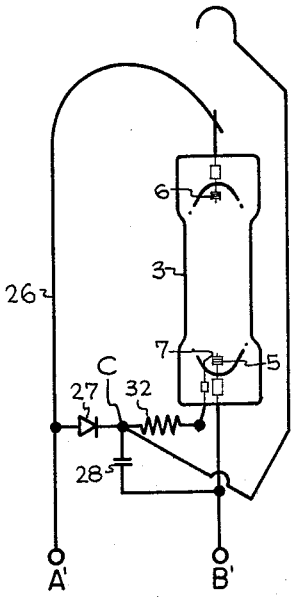
FIG. 6 is a diagram showing circuit connections in a modified construction.

A modified lamp construction which is preferred for lamps where the glow-to-arc transition voltage or second breakdown dominates the starting characteristic is illustrated diagrammatically in FIG. 6. Diode 27 and capacitor 28 are interposed in their connections to inleads 17 and 18, respectively. The polarity of the diode is chosen to maintain a positive potential at the junction which is applied to frame member 12, 12*a*. The voltage waveforms at starting are again illustrated in FIG. 3 but with inversion of the reference terminals. Terminal B′ now becomes the reference or ground point, and the sinusoidal curve represents the potential at terminal A′, as parenthetically indicated in FIG. 3. The voltage applied to the starter electrode relative to the reference point is represented as before by dotted line C. However voltage doubling now occurs across the starter-to-remote main electrode gap. I have found that this connection is preferable for lamps utilizing electrodes which are less effective electron emitters. For instance in metal halide lamps utilizing a filling of mercury, sodium iodide and scandium iodide and wherein thorium rather than thorium oxide is used for electrode activation, this circuit is preferable to that of FIG. 2. The circuit of FIG. 6 may be used in substantially the same physical lamp structures previously described.

What I claim as new and desire to secure by Letters Patent of the United States is:

1. A high intensity arc discharge lamp comprising:

a vitreous arc tube containing an ioniable medium and having main electrodes sealed into opposite ends plus a starter electrode adjacent to the main electrode at one end;

an outer envelope enclosing said arc tube and having a stem at one end with inleads sealed therethrough;

a base attached to said outer envelope and having input terminals, said inleads being connected exteriorly to said input terminals and interiorly to said main electrodes;

a mount comprising at least one conductor extending through said envelope, said mount having attachments to said arc tube for supporting it;

a voltage doubling circuit comprising a diode and a capacitor connected in series across said input terminals and having their junction connected to said mount conductor;

said diode being poled to generate a positive potential at mount conductor member whereby to oppose positive ion electrolysis through the walls of said arc tube;

and a connection between said junction and said starter electrode serving to apply a positive bias thereto to facilitate starting.

2. A lamp as in claim 1 wherein the capacitor is connected between the remote main electrode and the junction, and the diode is connected between the adjacent main electrode and the junction in order to double the starting voltage across the starter-to-adjacent main electrode gap.

3. A lamp as in claim 1 wherein the capacitor is connected between the adjacent main electrode and the junction, and the diode is connected between the remote main electrode and the junction in order to double the starting voltage across the starter-to-remote main electrode gap.

4. A lamp as in claim 1 wherein said mount conductor is a metal frame member having attachments to said arc tube for supporting it.

5. A lamp as in claim 4 wherein said diode and capacitor are located within said outer envelope and wherein said metal frame member includes a rod seized in an insulating glass bead attached to one of said inleads at the stem end of the outer envelope and extending to the opposite end of said outer envelope.

6. A lamp as in claim 4 wherein said diode and capacitors are located within said outer envelope and wherein said metal frame member includes a rod attached to a dummy inlead in said stem and extending to the opposite end of said outer envelope.

7. A lamp as in claim 4 wherein said metal frame member includes a rod attached to a third inlead extending through said stem and at least said diode is located outside said outer envelope.

8. A high intensity arc discharge lamp comprising:

an arc tube containing an ionizable medium and having main electrodes sealed into opposite ends plus a starter electrode adjacent to the main electrode at one end;

input terminals connected to said main electrodes;

a voltage doubling circuit comprising a diode and a capacitor connected in series across said input terminals, said capacitor being connected to said remote main electrode, said diode being connected to said adjacent main electrode, and said diode being poled to generate a positive potential at its junction with said capacitor;

and a resistor connected between said junction and said starter electrode serving to apply a positive bias thereto whereby to approximately double the starting voltage across the starter-to-adjacent main electrode gap.

9. A lamp as in claim 8 wherein the discharge medium comprises mercury and a sodium halide and wherein the main electrodes are activated by thorium oxide.

10. A high intensity arc discharge lamp comprising:

an arc tube containing an ionizable medium and having main electrodes sealed into opposite ends plus a starter electrode adjacent to the main electrode at one end;

input terminals connected to said main electrodes;

a voltage doubling circuit comprising a diode and a capacitor connected in series across said input terminals, said capacitor being connected to said adjacent main electrode, said diode being connected to said remote main electrode, and said diode being poled to generate a positive potential at its junction with said capacitor;

and a resistor connected between said junction and said starter electrode serving to apply a positive bias thereto whereby to approximately double the starting voltage across the starter-to-remote main electrode gap.

11. A lamp as in claim 10 wherein the discharge medium comprises mercury and a sodium halide and wherein the main electrodes are activated by thorium.

* * * * *